US008035374B1

(12) United States Patent
Girrell et al.

(10) Patent No.: US 8,035,374 B1
(45) Date of Patent: Oct. 11, 2011

(54) PIPE STRESS DETECTION TOOL USING MAGNETIC BARKHAUSEN NOISE

(75) Inventors: Bruce I. Girrell, Traverse City, MI (US); Thomas A. Johnson, Kalkaska, MI (US); Ameet V. Joshi, Traverse City, MI (US); Douglas A. Spencer, Williamsburg, MI (US)

(73) Assignee: Microline Technology Corporation, Traverse City, MI (US)

( * ) Notice: Subject to any disclaimer, the term of this patent is extended or adjusted under 35 U.S.C. 154(b) by 366 days.

(21) Appl. No.: 12/245,054

(22) Filed: Oct. 3, 2008

Related U.S. Application Data

(60) Provisional application No. 60/977,793, filed on Oct. 5, 2007.

(51) Int. Cl.
*G01V 3/00* (2006.01)

(52) U.S. Cl. ..... 324/303

(58) Field of Classification Search ..... 324/300–322
See application file for complete search history.

(56) References Cited

U.S. PATENT DOCUMENTS

| | | | | |
|---|---|---|---|---|
| 2,814,019 | A | 11/1957 | Bender | |
| 3,667,035 | A * | 5/1972 | Slichter | 324/303 |
| 3,942,373 | A | 3/1976 | Rogers | |
| 3,994,163 | A | 11/1976 | Rogers | |
| 4,105,071 | A | 8/1978 | Nicolas et al. | |
| 4,207,765 | A | 6/1980 | Kiff | |
| 4,351,186 | A | 9/1982 | Moulin | |
| 4,352,065 | A | 9/1982 | Rogachev et al. | |
| 4,444,050 | A | 4/1984 | Revett | |
| 4,708,204 | A | 11/1987 | Stroud | |
| 4,719,803 | A | 1/1988 | Capelle et al. | |
| 4,766,764 | A | 8/1988 | Trevillion | |
| 4,966,234 | A | 10/1990 | Whitten | |
| 5,172,480 | A | 12/1992 | Labuc et al. | |
| 5,375,476 | A | 12/1994 | Gray | |
| 5,520,245 | A | 5/1996 | Estes | |
| 5,720,345 | A | 2/1998 | Price et al. | |
| 6,288,535 | B1 | 9/2001 | Chass | |
| 6,851,476 | B2 | 2/2005 | Gray et al. | |
| 6,854,336 | B2 | 2/2005 | Buttle | |
| 7,038,444 | B2 | 5/2006 | Crouch et al. | |
| 7,116,182 | B2 | 10/2006 | Varsamis et al. | |
| 7,128,988 | B2 | 10/2006 | Lambeth | |
| 7,150,317 | B2 | 12/2006 | Barolak et al. | |
| 7,660,197 | B2 * | 2/2010 | Barolak | 367/35 |
| 2009/0003130 | A1 * | 1/2009 | Barolak | 367/35 |

* cited by examiner

*Primary Examiner* — Dixomara Vargas
(74) *Attorney, Agent, or Firm* — Gardner, Linn, Burkhart & Flory, LLP

(57) ABSTRACT

A tool disposable within a well pipe, such as for detecting a freepoint of a well pipe, includes an electromagnet capable of inducing a magnetic field within a wall of a well pipe. The tool includes a Barkhausen noise sensing device capable of sensing magnetic Barkhausen noise in response to the electromagnet inducing the magnetic field within the wall of the well pipe. The tool may be moved along the well pipe so as make two passes of the tool along the well pipe, with one pass being performed while the well pipe is less stressed and the other pass being performed while the well pipe is more stressed, with the output of the tool during a first pass being compared to the output of the tool during a second pass to determine the location of the freepoint of the well pipe.

33 Claims, 8 Drawing Sheets

PIPE STRESS DETECTION TOOL USING MAGNETIC BARKHAUSEN NOISE

CROSS REFERENCE TO RELATED APPLICATION

The present application claims the benefit of U.S. provisional application Ser. No. 60/977,793, filed Oct. 5, 2007, which is hereby incorporated herein by reference in its entirety.

BACKGROUND OF THE INVENTION

1. Technical Field of the Invention

The present invention relates to generally to a method of detecting and identifying the most beneficial point to part or cut well pipe in order to recover it from a well. More specifically, the present invention relates to a method and apparatus to determine the location of the point along a length of well pipe where the well pipe is bound by rock, mud, or cement.

2. Description of Related Art

The ability to locate the point at which a tubular is stuck within another or within a well bore is useful. An accurate determination of the location of a stuck point (also referred to as a "freepoint") makes it possible to position tools to conduct recovery operations. Prior art devices include a number of devices which are intended for down-hole deployment. Most of these tools require applying tension or torsion to the well pipe. By measuring certain characteristics before application of the force and during application of the force, a determination can be made regarding the location of the sticking point.

Such known devices typically fall into two general categories. One category of tools measures well pipe displacement when stress is introduced into the well pipe. For example, the well pipe may be stretched or twisted and physical distance measurements quantify the movement or displacement of the well pipe or a section of the well pipe when it is stretched or twisted. These measurements are used to calculate how much of the well pipe is above the freepoint. A second type of tools relies on the ability to detect changes in a well pipe characteristic other than displacement. Various such detection methods include Hall Effect devices, strain gauges, and devices measuring magnetic permeability.

An example of such a device is disclosed in U.S. Pat. No. 4,708,204. The device disclosed in U.S. Pat. No. 4,708,204 detects changes of magnetic permeability when a motive force, such as tension or torque, is applied to a well pipe. Another known device is disclosed in U.S. Pat. No. 4,766,764, which discloses a device that uses Hall Effect sensors to measure and compare the absolute magnetic strength in the well pipe.

SUMMARY OF THE INVENTION

The present invention relates to a freepoint detection tool and a sensor assembly for use in a freepoint detection tool. The present invention identifies regions of induced elastic deformation to identify a freepoint in a well pipe by using magnetic Barkhausen noise analysis.

According to an aspect of the present invention, a method of determining a freepoint location of a well pipe includes providing a detection tool that is movable along a well pipe, moving the detection tool along a section of the well pipe, inducing a magnetic field into a wall of the well pipe to impart a reorientation of magnetic domains within the wall of the well pipe as the detection tool moves along the well pipe, sensing magnetic Barkhausen noise as the magnetic domains are reoriented and as the detection tool moves along the well pipe, collecting data indicative of the magnetic Barkhausen noise sensed along the well pipe as the detection tool moves along the well pipe, and processing the collected data to determine the location of the freepoint of the well pipe.

Optionally, the detection tool may be moved along a section of pipe by making two passes of the detection tool along the section of well pipe, with one pass being performed while the section of well pipe is unstressed or less stressed and the other pass being performed while the section of well pipe is stressed or more stressed. The method may further include comparing data collected during the two passes to determine the location of the freepoint of the well pipe. Optionally, the method may include determining a distance traveled by the detection tool or determining a location or depth of the detection tool as the detection tool moves along the well pipe in the first and/or second directions.

Optionally, the detection tool may include one or more rotatable electromagnetic coils and one or more rotatable sensor coils, such as a plurality of rotatable electromagnetic coils and sensor coils arranged at least partially circumferentially around a housing of the detection tool. An alternating magnetic field may be induced into a wall of the well pipe by rotating the electromagnetic coils while the detection tool is moved along the well pipe. The magnetic Barkhausen noise may be detected or sensed via the sensor coils as the magnetic domains are reoriented and as the detection tool is moved along the well pipe. Although one sensor assembly (such as a sensor assembly comprising a rotatable or fixed sensor coil) is sufficient to determine the location of a freepoint in a well pipe, the inclusion of additional sensors provides redundancy as well as noise cancellation capabilities, and thus may be preferred, depending on the particular application of the detection tool of the present invention.

Optionally, the detection tool may include a plurality of non-rotating electromagnetic coils and sensor coils that are selectively arranged along a longitudinal axis of the detection tool, with the longitudinal axis of the tool being generally parallel with the first direction of travel of the detection tool. Each of the electromagnetic coils and the sensor coils may be oriented at a respective angle relative to the longitudinal axis of the detection tool. An alternating magnetic field may be induced into a wall of the well pipe by selectively or sequentially energizing the electromagnetic coils as the detection tool is moved along the well pipe. The magnetic Barkhausen noise may be sensed or detected via the sensor coils as the magnetic domains are reoriented and as the tool is moved along the well pipe.

The present invention thus uses a method to locate the freepoint that has not been previously proposed. This method employs magnetic Barkhausen noise to analyze strain within the well pipe in order to locate the freepoint in a well. While the application of force to the well pipe during the detection process may be similar to the techniques used by the prior art devices, the method of detecting and identifying the freepoint itself has not been previously described or suggested or employed.

These and other objects, advantages, purposes and features of the present invention will become apparent upon review of the following specification in conjunction with the drawings.

DESCRIPTION OF THE PREFERRED EMBODIMENTS

Figure 1A:
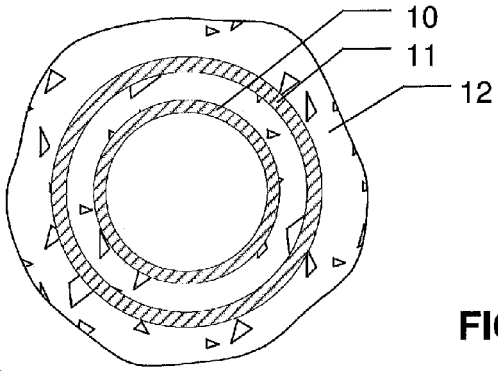
FIG. 1A shows a horizontal cross section of a well illustrating a freepoint.

The present invention provides a system and method for detecting the freepoint of a well pipe. The freepoint detection system of the present invention includes a freepoint detection tool that is deployable within a well pipe within a well casing within a well bore. The freepoint detection tool is comprised of a chassis, an electrical power source, control circuitry, a number of sensor assemblies, and data acquisition electronics. The freepoint detection tool is lowered into the well pipe and is operable to induce an alternating magnetic field into the pipe wall and to detect the magnetic Barkhausen noise that is correspondingly produced, in order to determine the location of the freepoint along the well pipe, as discussed below.

The need exists for petroleum producing companies to recover well pipe from oil wells. During drilling operations, drill strings sometimes become stuck for various reasons. Additionally, well pipes are sometimes cemented into place to prevent unwanted vertical migration of liquids within the well. When the well pipe is bound, whether by rock, mud or cement, the point at which the well pipe is stuck is called the freepoint. Whether the well pipe becomes stuck during drilling operations or is cemented into place for production purposes, locating the freepoint (the point where the well pipe is stuck below and free above) is a necessary process in order to recover as much of the well pipe as possible.

Determining the exact location of the freepoint is sometimes difficult. In the past, a number of devices have been used to locate the freepoint. Various techniques are used, many of which rely on either pulling on the well pipe to stretch it or by applying torque to the well pipe. Methods of locating the freepoint by stretching or twisting the well pipe vary. Well pipe stretching or twisting methods typically rely on the sticking point acting as a restraint. Well pipe above the freepoint stretches or twists and well pipe below the freepoint remains fixed and does not stretch or twist or deform or distort.

Sometimes the well pipe is stretched to measure the total amount of stretch under a known load to calculate the freepoint. In some other situations, a tool is sent down the well to measure localized stretching. Such tools detect stretching by measuring between two points that are relatively close together. To measure the degree of stretch of the well pipe, the tool anchors itself to the well pipe, whereby anchors at the top and bottom of the tool secure opposite ends of a measuring device to the well pipe when the well pipe is in a relaxed state. When tension is applied to the well pipe, the measuring instrument stretches with the stretched well pipe to detect any stretching within the length of the tool.

With localized stretching methods, the tool is lowered into the well pipe to take measurements at regular intervals. At each interval, the tool is locked into place and the well pipe stretched and measured. Then the tension is removed from the well pipe, the tool released from the pipe wall, and the tool is lowered to the next testing point. The process is repeated until the tool descends below the freepoint, as indicated by a lack of stretching when the well pipe is put under tension. Below the freepoint, the well pipe remains free of distortion regardless of whether the well pipe is under tension or not.

In addition to longitudinal stress (stretching), rotational stress can be employed when determining the location of the freepoint. By rotating the top of the well pipe, the stress induced into the well pipe can be measured with instruments such as strain gauges and the like. In a process similar to stretching techniques, a force is applied to the top of the well pipe. However, this method employs rotational force instead of a tensile force. Like the stretching method, the force applied to the well pipe is manifested throughout the portion of the well pipe from the point where the force is applied, down to the freepoint. The freepoint acts as a vice and grips the well pipe. Well pipe further down the hole remains relatively stress-free. Strain gauges, or other similar devices, are lowered into the well and monitored while rotational force is applied to the well pipe. When the instrument indicates a location where the strain suddenly drops off, it indicates the tool is below the freepoint.

Once the freepoint is located, the well pipe is typically cut or backed-off just above the freepoint. Once the well pipe above the freepoint is separated from the rest of the string, the remaining portion of the string can be removed through the use of specialized washing and fishing equipment.

Figure 1B:
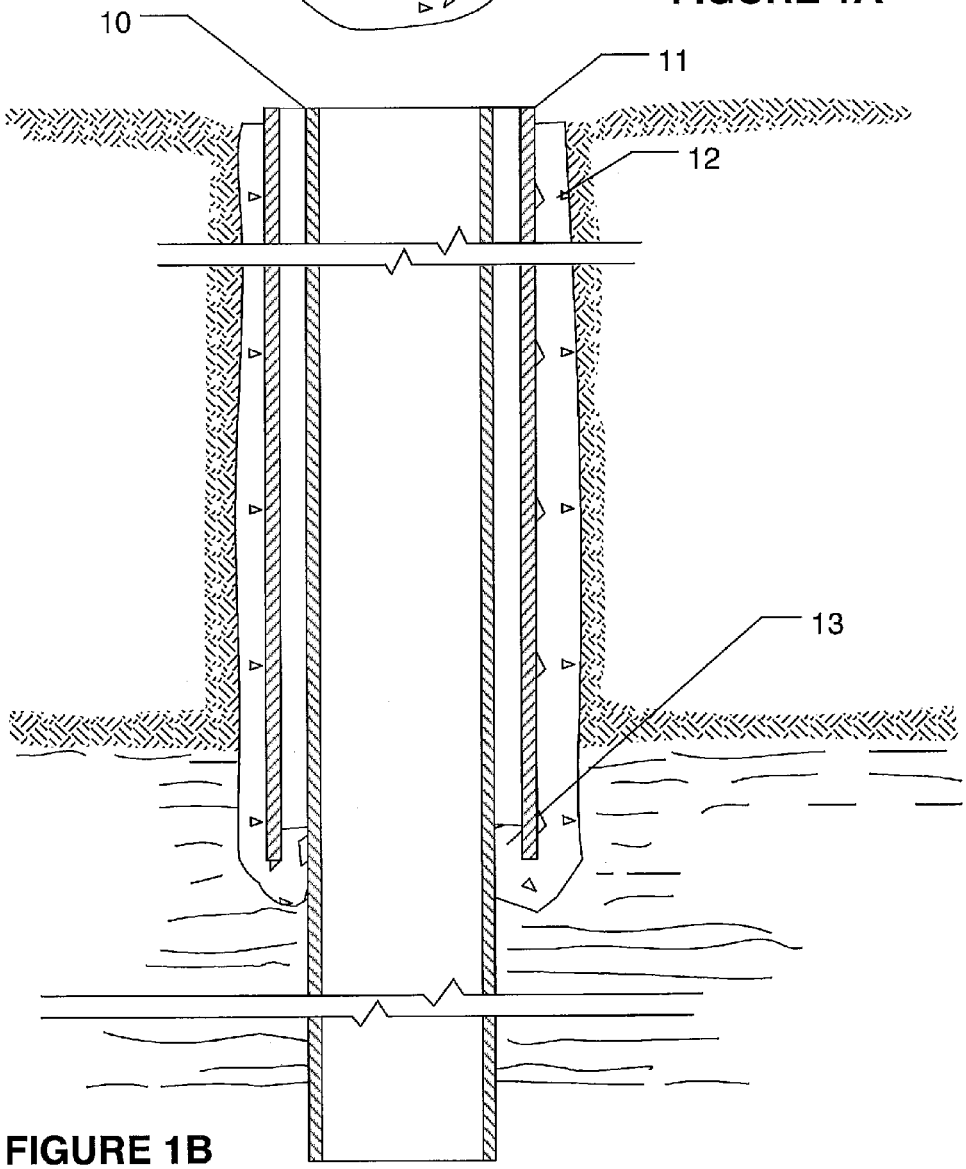
FIG. 1B shows a vertical cross section of the well of FIG. 1A.
Figure 2:
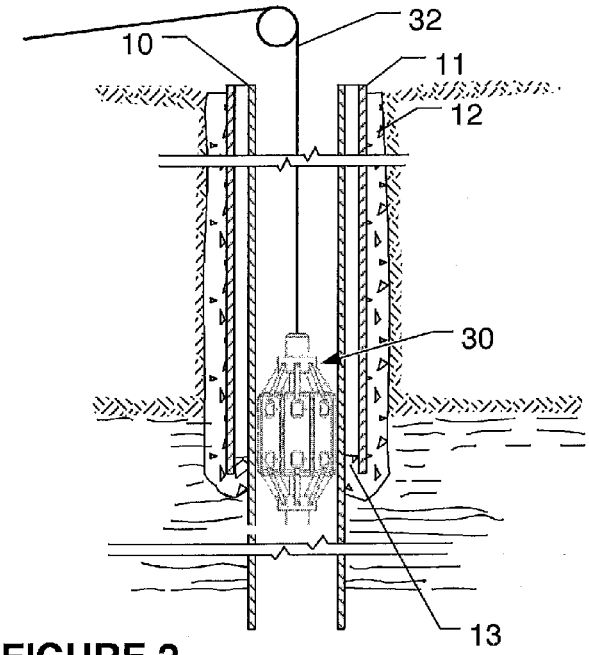
FIG. 2 depicts a freepoint detection tool of the present invention, as deployed in a well pipe.

Referring now to the drawings and the illustrative embodiments depicted therein, a freepoint detection system 100 of the present invention includes a freepoint detection tool or freepoint tool 30 that is lowerable into a well pipe 10 and that is operable to detect the location of the freepoint of the well pipe 10 (FIG. 2). As can be seen in FIGS. 1A, 1B and 2, the well pipe 10 may be disposed within a well casing 11 that is cemented or secured in place within a well bore, such as with cement 12 or the like. The cement at the lower end of the well casing may provide a cemented annulus 13 and may bind the well pipe 10. When the well pipe is bound, whether by rock, mud or cement, the point at which the well pipe is stuck is called the freepoint.

In the illustrated embodiment, freepoint tool 30 comprises a housing or chassis 26 (such as a generally cylindrical housing or frame of the illustrated embodiment) that houses or supports a plurality of sensor assemblies 20. As shown in FIGS. 3-7, each sensor assembly 20 includes a rotating electromagnetic coil 23 that is rotatable (such as via a rotational drive device or motor or stepper motor 21) to generate or induce an alternating magnetic field into the pipe wall (when the freepoint tool is disposed within the well pipe) to impart a reorientation of the magnetic domains within the ferromagnetic material of the pipe wall. The sensor assemblies 20 each include a sensor coil 25 that rotates with the electromagnetic coil 23 and detects the electrical impulses (magnetic Barkhausen noise or MBN) as the magnetic domains are being reoriented. The sensor assemblies 20 generate output signals that are received and processed to determine changes in the MBN detected to determine the location of the freepoint of the well pipe, as discussed below.

Description of the Components

As discussed above, each sensor assembly 20 of freepoint tool 30 comprises an electromagnetic coil 23 and a sensor coil 25. Each electromagnetic coil 23 is powered by a sine wave generator or oscillating power supply 24 operating at or around 12 HZ. Each sensor assembly 20 is attached to and/or driven by stepper motor 21 in order to rotate the electromagnetic coil and the sensor coil of the respective sensor assembly. When the freepoint tool 30 is located within a well pipe and the sensor assembly is activated, the rotating electromagnetic coil 23 induces an alternating magnetic field into the pipe wall at or near the sensor assembly, thereby causing a reorientation of the magnetic domains within the ferromagnetic material of the pipe walls. The sensor coil 25 rotates with the electromagnetic coil 23 and detects the electrical impulses (magnetic Barkhausen noise or MBN) as the magnetic domains are being reoriented.

Figure 10:
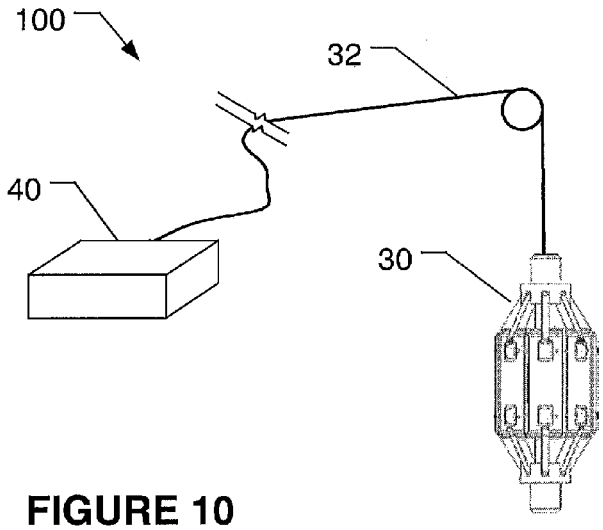
FIG. 10 depicts a freepoint detection tool of the present invention, as supported by a cable for deployment in a well pipe, with an electrical cable connecting the detection tool to a processing device or controller.

The magnetic Barkhausen noise is produced by the rapid and abrupt reorientation of the magnetic domains, thereby inducing high frequency current (3 kHz to 200 kHz) into the sensor coil 25. The sensor coil 25 is electrically connected to a signal processor 22, which may convert the electrical impulses into a digital signal and/or which may record the output of the sensor coil in a suitable format. The current induced into the sensor coil is preferably sampled at a rate higher than the Nyquist rate (typically about two times the bandwidth so as to define a lower bound for the sample rate for alias-free signal sampling) and recorded in a digital format. The onboard processor may store the data in memory for later analysis, or may transmit data (such as via a transmitter) to a remote control or processor 40, such as shown in FIG. 10, for current processing/analysis, while remaining within the spirit and scope of the present invention.

During operation of the freepoint detection system 100, an operator may monitor the incoming data in various ways. The data may be monitored graphically or as numeric values or other suitable monitoring means. Depending on the characteristics of the well pipe, various parameters, such as energy, frequency, amplitude and waveform and the like, may be analyzed to quantify stresses in the well pipe or to isolate the boundaries between stressed material and unstressed material.

Figure 3:
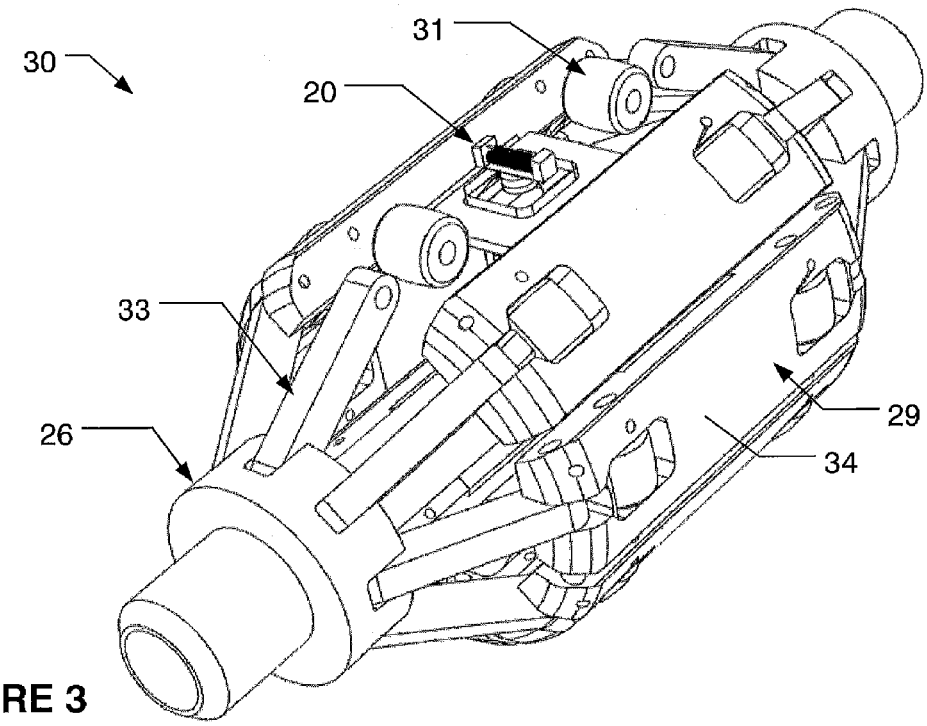
FIG. 3 is an isometric view of the freepoint detection tool of the present invention.
Figure 4:
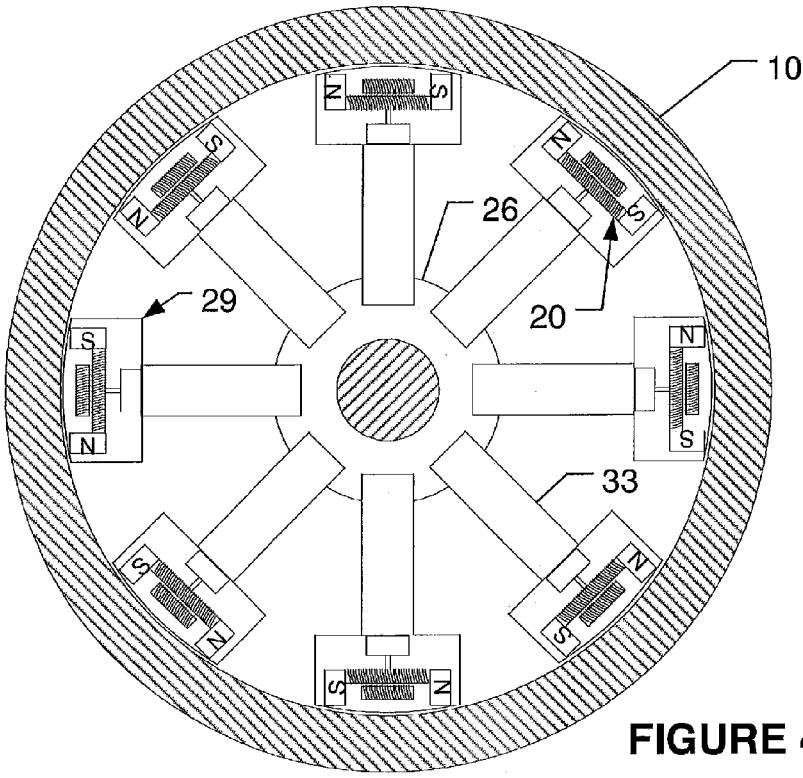
FIG. 4 is a cross sectional view of the freepoint detection tool of the present invention, as positioned inside a well pipe.
Figure 5:
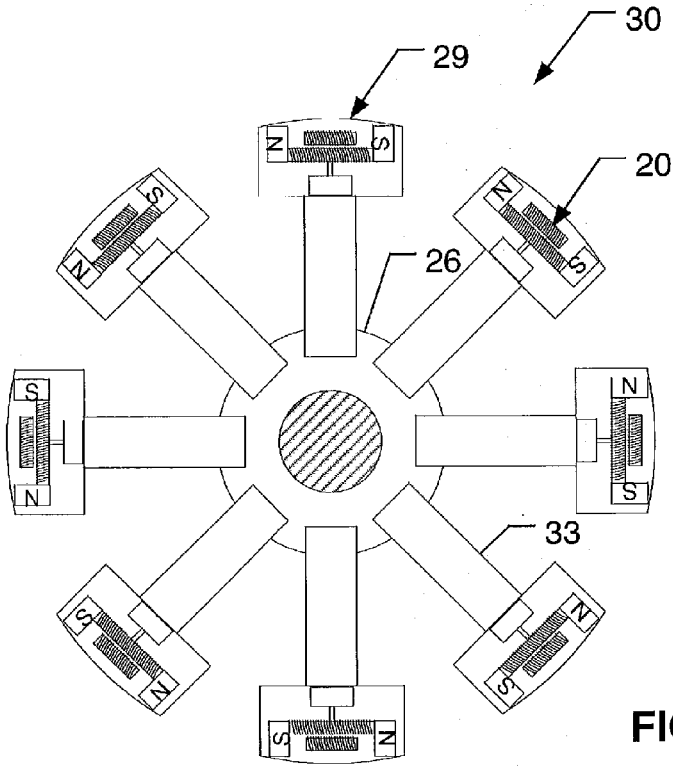
FIG. 5 is a cross section of a freepoint detection tool of the present invention, showing a preferred arrangement of rotating sensor assemblies.
Figure 6:
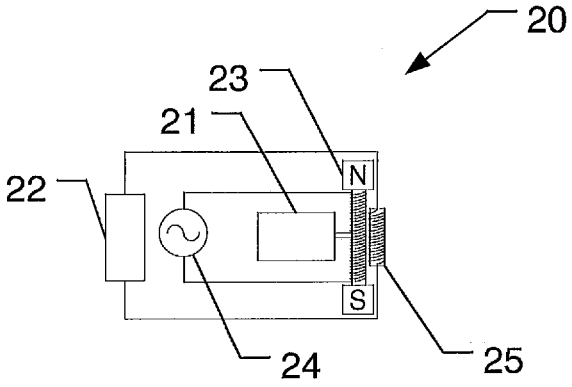
FIG. 6 is a schematic diagram of a magnetic Barkhausen noise sensor assembly for use in a freepoint detection tool in accordance with the present invention.
Figure 7:
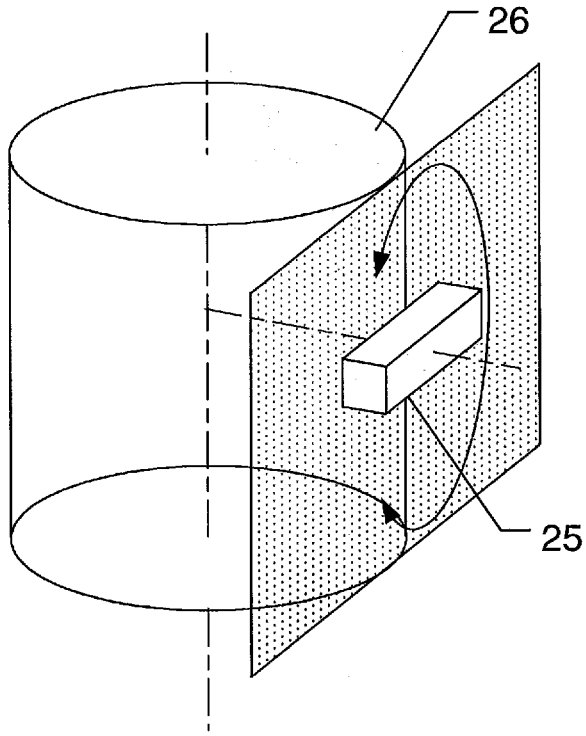
FIG. 7 is a conceptual view illustrating the rotational axis for fixed sensor placement.

The tool frame or chassis or housing 26 of freepoint detection tool 30 is designed or formed or constructed to position the sensor assemblies 20 close to the pipe wall without direct contact between the sensor and the pipe wall. In the illustrated embodiment, the tool housing or chassis 26 is a generally cylindrical housing or frame having an outer diameter that is less than the inner diameter of the well pipe to be analyzed, so that the tool may be received within the well pipe and readily moved along the well pipe. In the illustrated embodiment, the tool chassis 26 has a plurality of apertures at its outer wall or surface for receiving respective sensor assemblies, so that the electromagnetic coils and sensor coils are at or near the outer surface of the chassis and thus at or near the inner surface of the well pipe when the tool is received within the well pipe. As can be seen in FIGS. 2 and 3, the sensor assemblies are spaced apart circumferentially around the housing or chassis 26 so as to provide a generally horizontal row of spaced apart sensor assemblies at or near the outer surface of the freepoint tool 30.

In the illustrated embodiment, frame or chassis 26 of freepoint tool 30 includes or supports a plurality of movable or adjustable shoes 29, such as disposed about a perimeter or circumferential surface of the chassis 26. The shoes 29 may be spring-loaded or otherwise biased or configured to self-adjust in a radial direction from the centerline of the tool and toward engagement with the inner surface of the well pipe in which the detection tool is disposed. The shoes may be connected to the tool chassis by respective arms or mounting members 33 that allow for radial movement of the shoes relative to the chassis or frame.

The adjustable shoes allow the tool to pass through, or operate within, pipes with different inside diameters while keeping the tool centralized within the pipe and while keeping the sensor assembly or sensor assemblies 20 close to the pipe wall without direct contact between the sensor assembly and the pipe wall. The shoes are preferably closely aligned with the longitudinal axis of the tool so as to maintain the housing or chassis at or near the centerline of the well pipe in which the detection tool is disposed. As can be seen in FIG. 3, the sensor assemblies of the detection tool may be housed or disposed or contained within the shoes (such as within a shoe plate or sensor housing 34 of the respective shoe 29, with the plate being removed from one of the shoes in FIG. 3 to show additional details). The sensor assembly may be contained within the shoe plate or sensor housing (and at or near the outer surface of the sensor housing, or the sensor assembly may be disposed at or in or partially in a recess or aperture formed at the sensor housing (such as in a similar manner as sensor assemblies 120 of detection tool 130, discussed below). Optionally, the shoes 29 may be equipped with one or more rollers or wheels 31 rotatably mounted to the shoe plate or housing 34 to reduce or minimize friction between the shoe and the pipe wall as the detection tool moves along the well pipe, or the shoes may be equipped with any other suitable type of friction reducing device to reduce or minimize friction between the shoe and the pipe wall. The shoe assembly may be designed to maintain an optimal distance between the sensor assembly and the pipe wall as the detection tool is moved along the well pipe.

Figure 11:
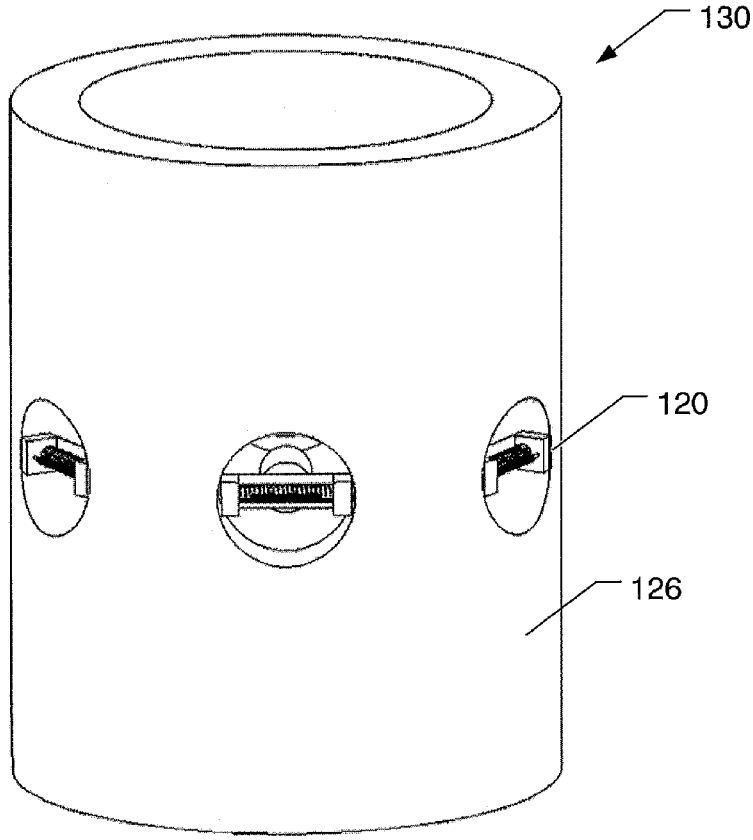
FIG. 11 is a perspective view of another freepoint detection tool of the present invention.
Figure 12:
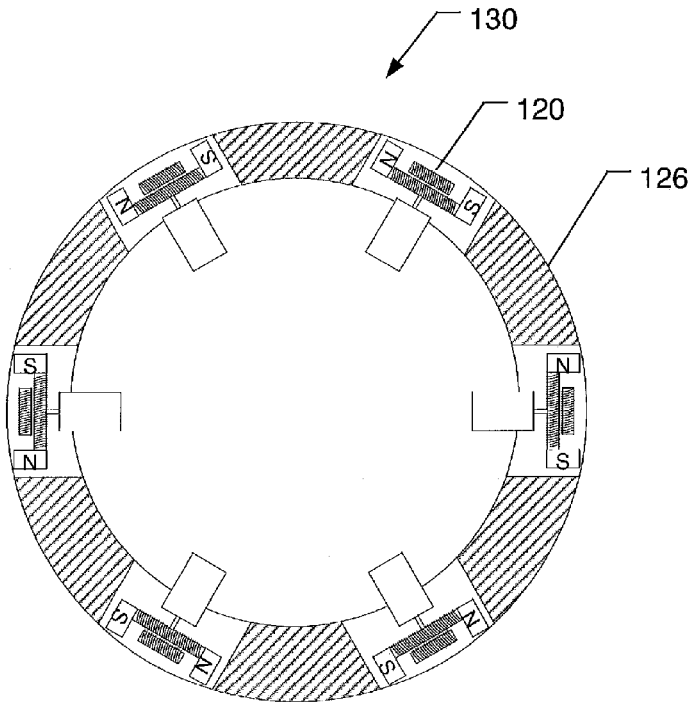
FIG. 12 is a sectional view of the freepoint detection tool of FIG. 11.

Although shown and described as having a housing with shoes and wheels or rollers to assist the detection tool in moving along the well pipe, it is envisioned that other housings or frames may be implemented with the detection tool while remaining within the spirit and scope of the present invention. For example, and with reference to FIGS. 11 and 12, a tool housing or chassis 126 of a detection tool 130 may comprise a generally cylindrical housing having an outer diameter that is less than the inner diameter of the well pipe to be analyzed, so that the tool may be received within the well pipe and readily moved along the well pipe. In the illustrated embodiment, the tool chassis 126 has a plurality of apertures at its outer wall or surface for receiving respective sensor assemblies 120, so that the electromagnetic coils and sensor coils are at or near the outer surface of the chassis and thus at or near the inner surface of the well pipe when the tool is received within the well pipe. As can be seen in FIGS. 11 and 12, the sensor assemblies are spaced apart circumferentially around the housing or chassis 126 so as to provide a generally horizontal row of spaced apart sensor assemblies at or near the outer surface of the freepoint detection tool 130.

The detection tool of the present invention is thus configured to be moved along the well pipe, such as via lowering and raising the tool via a cable or moving element 32 (FIG. 2), which may be attached to or connected to a winch or the like at an above ground level above or at or near the upper end of the well pipe. Optionally, the detection tool may be otherwise moved along the well pipe, such as via motorized rollers or wheels that engage the walls of the well pipe and that are rotatably driven to impart a translational movement of the tool along the well pipe. Optionally, the chassis may be equipped with rollers or slides or other devices or elements that function to keep the tool generally centrally located within the well pipe and to reduce or limit friction between the tool and the well pipe as the tool is moved along the well pipe, such as discussed above.

Optionally, and preferably, the freepoint detection tool may be equipped with a distance measuring device or odometer type device (such as, for example, a roller that engages the inner surface of the well pipe with control circuitry that monitors rotations of the roller to determine the distance traveled along the well pipe, or an altimeter type device that detects the altitude of the device, such as for substantially vertically oriented well pipes, or other distance or location detection means), which is operable to measure the distance that the tool travels along the well pipe or otherwise determine the location of the tool along the well pipe. Optionally, the odometer or distance or location input may also be used as a trigger or timing mechanism for data collection, such as for collecting data at regular intervals as the tool travels along the well pipe.

Operation of the System

During operation of the freepoint detection system of the present invention, the freepoint detection tool assembly is preferably lowered into a well or well pipe at a substantially constant rate. As the tool descends, the sensors detect and the instrument records the magnetic Barkhausen noise (MBN) as each electromagnetic coil and sensor coil assembly rotates relative to the tool chassis and the well pipe. The freepoint detection system collects the MBN data and processes the data (or provides the data to a user for human processing/analysis) to determine the location of the freepoint of the well pipe, as discussed below.

The freepoint detection system of the present invention relies on the freepoint tool's ability to induce an oscillating magnetic field into the steel well pipe. When a ferromagnetic material is applied with a magnetic field, the material becomes magnetized depending on its magnetic properties. The time and extent of magnetization might vary for different materials, but the process of magnetization always involves a corresponding occurrence of MBN. Magnetic Barkhausen noise occurs as tiny magnetic domains change orientation as a result of the induced magnetic fields. As the magnetic field changes, the magnetic domains seek a new orientation within the pipe wall. The changing orientation of each magnetic domain changes the magnetic field around it, and the changing magnetic field induces a current in the sensor coil that is located at or close to the pipe wall. Such induced current is commonly referred to as MBN. The freepoint detection system of the present invention records the MBN, which can be subsequently analyzed using software, or which can be output or represented or displayed in a format that allows for human analysis of the system output.

Figures 8A, 8B, 8C:
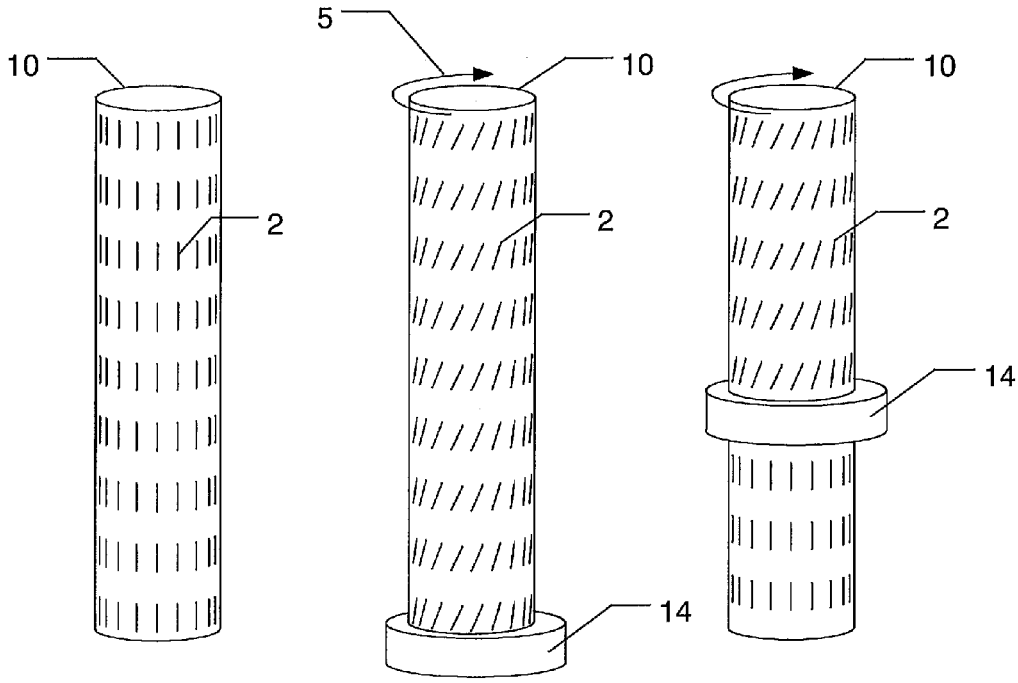
FIGS. 8A-C are conceptual diagrams of the alignment of the magnetic easy axis, with FIG. 8A showing a well pipe without an external force applied to the well pipe, FIG. 8B showing rotational stress applied to the well pipe and the effect of the stress on the magnetic easy axis, and FIG. 8C showing a well pipe with a freepoint midway along the well pipe.

In a cylindrical well pipe, such as well pipe 10, the magnetic domains are typically arranged generally along the axial direction of the well pipe. Although the domains are arranged along the axis of the well pipe, the North and South poles are randomly oriented. As a result, the well pipe does not exhibit any magnetism. However, when a magnetic field is induced into the well pipe, those magnetic forces attempt to magnetize the well pipe. In these situations, the well pipe tends to have the strongest magnetism in axial direction. This direction is called the "magnetic easy axis" (MEA) of the well pipe. As shown in FIG. 8A, the MEA 2 of the well pipe 10 is oriented along the longitudinal axis of the well pipe when the well pipe is in a non-stressed condition or substantially non-stressed condition. To determine the MEA, the sensor coil is rotated 360 degrees at a fixed location and MBN is recorded throughout the rotation. The angle of the sensor at which the MBN is the highest is called the MEA.

Ideally, the instrument would remain stationary during a full revolution of the sensor coils, in order to provide a full sensor revolution at each location along the well pipe. However, from an operational standpoint, it is preferable to translate or move the instrument or tool through the well pipe at a slow, but constant or substantially constant rate or velocity. To obtain the best results, the sensor assembly may be rotated at a high rate while the speed of translation of the tool along the well pipe is proportionally slow, thereby providing results that approximate the results that would have been obtained if the tool were stationary for each rotation of the sensor assembly.

When a well pipe is under stress, the magnetic easy axis (MEA) of the well pipe rotates away from the longitudinal axis. For example, and with reference to FIG. 8B, the MBA is shown at an angle relative to the longitudinal axis of the well pipe when the well pipe is under a rotational or torsional stress (such as in response to a rotational force 5 or the like). This reoriented MEA may be determined or computed utilizing the aforementioned method of MBN inspection. As can be seen in FIG. 8C, if there is a physical restraint 14 at the well pipe (such as at the freepoint of the well pipe), the well pipe above the restraint or freepoint 14 is stressed and has its MEA angled relative to the longitudinal axis of the well pipe, while the well pipe below the restraint or freepoint 14 is unstressed or less stressed and has its MEA oriented generally along the longitudinal axis of the well pipe.

To employ the principle of magnetic Barkhausen noise detection in the field of locating a freepoint in an oil well, the freepoint device 30, which is capable of inducing the magnetic field into the well pipe and simultaneously detecting the resulting magnetic Barkhausen noise, as discussed above, is lowered into the well pipe 10 with the well pipe in a non-stressed or less stressed condition. During the tool's descent along the well pipe (with the electromagnetic coils rotating to induce the magnetic fields and with the sensor coils sensing the corresponding MBN as described above), the data is recorded in an electronic log and stored for analysis. The process is continued until the tool is lowered to a location that is presumed to be at or below the expected freepoint of the well pipe.

With the tool is lowered below the expected freepoint, the well rig (or other deformation device or means) may be used to induce stress into the well pipe, such as by either pulling at the upper portion of the well pipe to elastically stretch the well pipe above the freepoint, or applying a rotational force at the upper portion of the well pipe to twist the well pipe above the freepoint, or a combination of the two. As the drilling rig applies stress to the well pipe, the well pipe and its joints above the freepoint undergo a slight elastic deformation or distortion (either longitudinal deformation if the well pipe is pulled or stretched or rotational deformation if the well pipe is twisted or rotated). The section or sections of the well pipe below the freepoint is/are insulated from the rotational and/or pulling forces and remain in a relative state of relaxation or remain in an unstressed condition.

Figure 13:
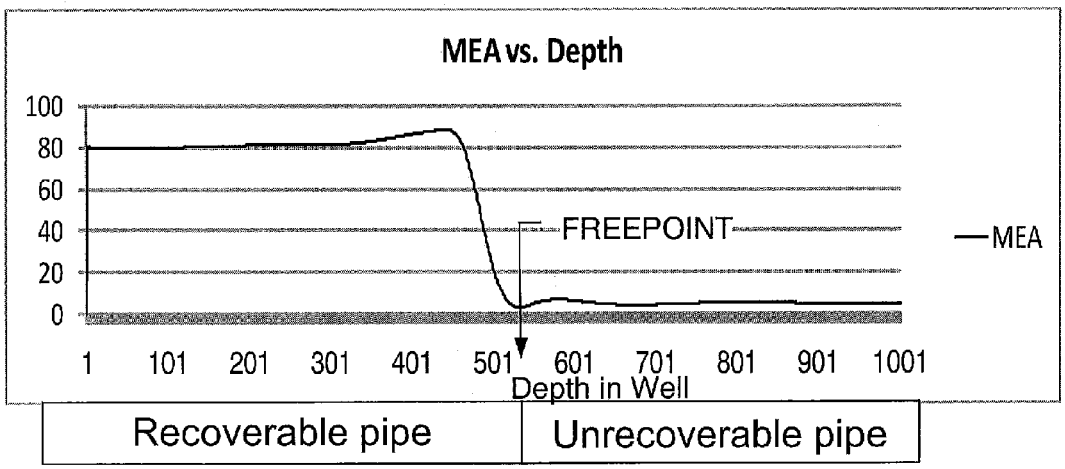
FIG. 13 is a graph of theoretical MEA data illustrating the depth of a freepoint of a well pipe.

After the well pipe is stressed and while the well pipe remains stressed or stretched or twisted (and is thus more stressed than the unstressed or less stressed condition), the freepoint tool is then raised upward along the well pipe (with the electromagnetic coils again rotating to induce the magnetic fields and with the sensor coils sensing the corresponding MBN as described above) and the tool output or collected data is monitored to detect any change in the MBN or MEA as compared to what was measured during the tool's descent. An increase in MBN, or a change in the MEA, as stress is induced into the well pipe, indicates the tool is still above the freepoint and should be lowered further into the well pipe. When the tool reaches a point where inducing stress no longer precipitates increasing MBN, the tool is raised and used to record data during the ascent. During the ascent, an operator may observe the collected data, and may compare the ascending log with the log made during the descent (or a processor may electronically or digitally compare the data to determine any changes or differences between the data). The operator may be able to visibly discern a notable difference between the two logs. A sudden change in appearance, character or values between the two logs indicates that the tool is at or is passing the freepoint. In particular, a marked change of MEA as indicated by a comparison of the logs indicates the location of the freepoint. In other situations, it is foreseen that computer analysis software may be employed to more accurately compare the data or to analyze data from a single log to determine the freepoint. As shown in FIG. 13, data may be obtained by a freepoint detection tool that pertains to the MEA along the well pipe and plotted for analysis. The vertical axis of the graph of theoretical data in FIG. 13 represents the angle of the Magnetic Easy Axis (MEA) and the horizontal axis indicates the distance into the well.

As the tool ascends along the well pipe, the data collected from the lower portion of the well pipe below the freepoint closely matches data from the descent log. When the tool reaches the freepoint, the difference between the two logs becomes readily apparent. Once the location of the freepoint is determined (which may be determined by determining the distance that the tool has traveled downward or along the well pipe (such as in response to an output of an odometer device or position locating device or the like of the tool) for the location of the tool that corresponds to the detected freepoint), the tool may be removed from the well pipe or may be used to detect the next collar above the freepoint. After the tool is removed from the well pipe, a back-off operation may be performed to remove the section or sections of well pipe above the detected freepoint.

The freepoint detection process of the present invention is described herein as moving or lowering the tool in a first or downward direction and then moving or raising the tool in a second or upward direction after and while the well pipe is stressed. However, it is envisioned that the well pipe may be first stressed prior to the first pass of the tool along the well pipe, whereby the second pass of the tool detects the magnetic Barkhausen noise of the unstressed or less stressed well pipe, and it is further envisioned that the tool could be first raised from an initial lowered point and then lowered after and while the well pipe is stressed, or that any other orders of processes may be implemented, while remaining within the spirit and scope of the present invention. Optionally, for example, the tool may be moved twice in the same direction, with one pass being while the well pipe is unstressed and the other pass being while the well pipe is stressed, while remaining within the spirit and scope of the present invention. Although the term "unstressed" is used herein, clearly this is not intended to refer only to a pipe that is wholly unstressed, but is intended to refer to a pipe that is less stressed during one pass of the tool than a degree of stress that is applied to the pipe for the other pass of the tool.

In the illustrated embodiment, the sensor assemblies are arranged and spaced circumferentially around a generally cylindrical housing or chassis and in a single row or level of sensor assemblies. The sensors are rotatable so that each section of the pipe wall adjacent to or at or near the respective sensor assembly is exposed to a full or near full rotation of the sensor as the tool passes any given point or region of the well pipe. However, other arrangements of sensor assemblies may be implemented while remaining within the spirit and scope of the present invention.

Figure 9:
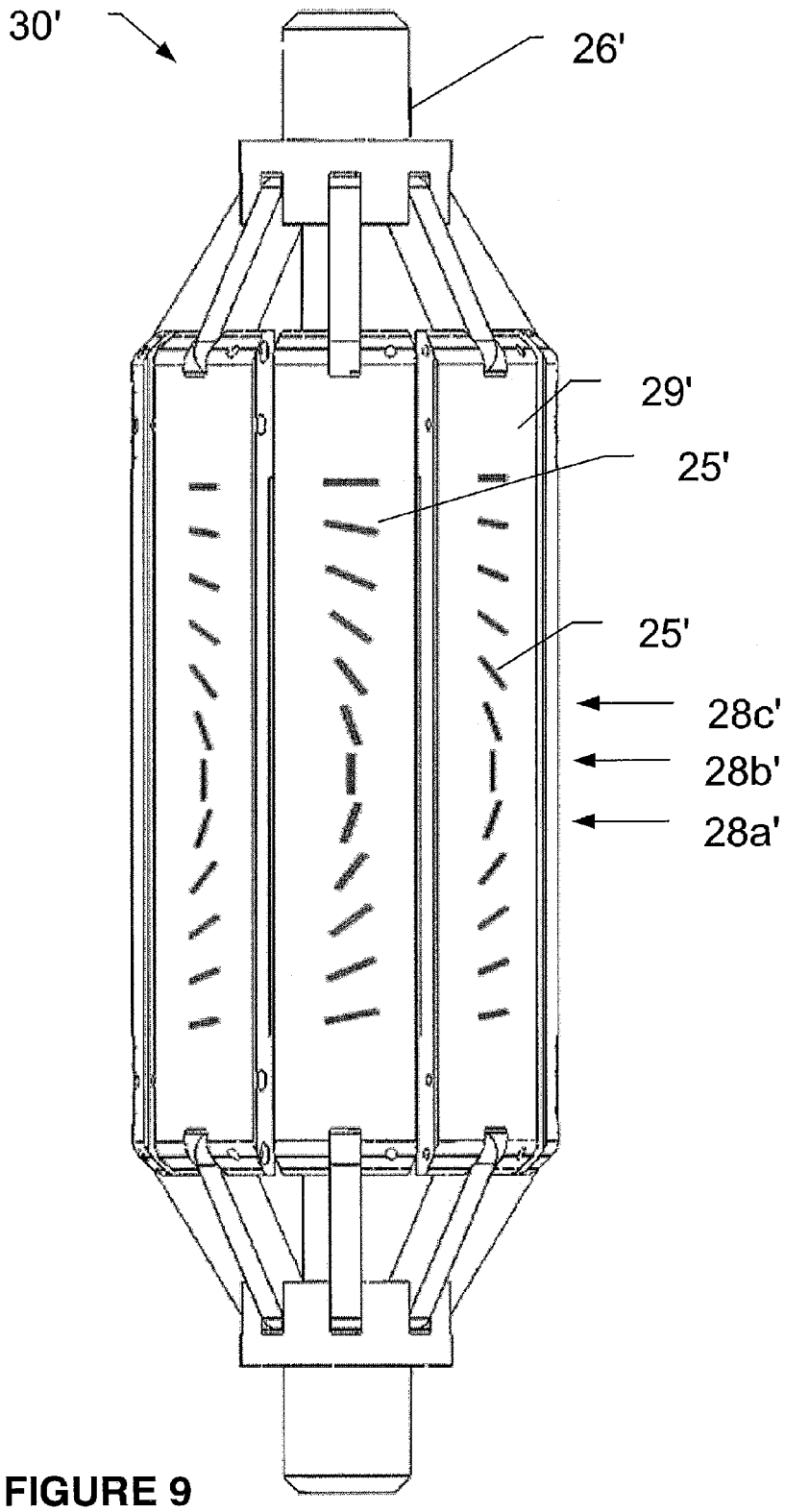
FIG. 9 is conceptual view of another freepoint detection tool of the present invention, illustrating the relative orientation of fixed sensors on a fixed sensor freepoint detection tool.

For example, and with reference to FIG. 9, it is envisioned that an alternative method of construction of a freepoint detection tool of the present invention is to replace the single row of rotating sensor assemblies with multiple rows of non-rotating sensor assemblies 25' arranged along a chassis or housing 26' of a freepoint detection tool 30' (such as along respective shoes 29' of the detection tool 30'). The rows of non-rotating sensor assemblies may be arranged at the outer surface or portion of the housing 26' and spaced apart along the longitudinal axis of the tool. Preferably, but not necessarily, the sensors of each row may be equally spaced around the circumference of the tool. The number of sensor assemblies in each row and the number of rows may vary depending on the size of the well pipe to be inspected and the desired resolution of the freepoint detection tool. The chassis and shoes of the detection tool 30' may be otherwise substantially similar to the chassis and shoes of detection tool 30, discussed above, such that a detailed discussion of the detection tools need not be repeated herein.

To provide a full range of data, the sensors in each respective row or ring of sensors may be oriented in the same direction, while each sensor has a different orientation relative to the sensors of other rows of sensors along the longitudinal axis of the chassis and well pipe. The sensors are systematically oriented differently from the sensors of the other rows by systematically placing the sensors for each of the rows of sensors of the tool with the sensor coils of each row of sensors oriented in a different direction, such that the sensor orientation varies from a fixed sensor in one row to a next fixed sensor of the adjacent row of sensors and so on. The sensor orientation thus varies from one fixed sensor to the next fixed sensor of an adjacent row of sensors and along the longitudinal axis of the chassis for each given radial or circumferential location of sensors. For example, and with reference to FIG. 9, a row 28*a*' of fixed sensors 25' may be oriented with the sensors being generally vertical or generally along or generally parallel to the longitudinal axis of the chassis or housing 26', while an adjacent row 28*b*' of fixed sensors 25' may be oriented with each of the sensors being angled relative to the longitudinal axis of the chassis or housing 26', and a third row 28*c*' of fixed sensors 25' may be oriented with each of the sensors being further angled relative to the longitudinal axis of the chassis or housing 26' and so on (and optionally in both directions as shown in FIG. 9). As can be seen in FIG. 9, each column of sensors along a particular portion of the cylindrical housing 26' includes sensors that collectively have multiple different orientations, such as orientations at various angles between about +/−90 degrees relative to the longitudinal axis of the housing 26'.

Thus, as the freepoint detection tool 30' is lowered into and along the well pipe and not rotated relative to the well pipe, the sensor orientation changes relative to each particular location along the well pipe. The sensor orientation is thus effectively rotated in a plane that is tangential to the outside of the tool body or chassis and that is parallel to the longitudinal axis of the tool. The incremental change in sensor angle or orientation along the detection tool may be selected depending on the number of sensors in each row of sensors and/or the number of rows of sensors along the freepoint detection device or tool.

As the tool translates through the well pipe, the tool systematically energizes the electromagnetic coils and samples data from the associated sensor coil to record MBN. For example, the system may energize each of the sensors of a particular row, such as the bottom row if the device is descending along a generally vertical well pipe, and sample data from the associated sensor coils, and may then energize each of the sensors of the next adjacent row of sensors, such as the sensor row immediately above the bottom row, and sample data from the associated sensor coils, and so on, as the tool is lowered down along the well pipe. The data collected by the tool is then processed to align the data from the sensors of each column of sensors (to account for the placement position along the length of the tool) and then analyzed to determine the angle of the magnetic easy axis of the well pipe.

Therefore, the present invention provides a freepoint detection tool and system and method that utilizes detection of magnetic Barkhausen noise along the well pipe or section of well pipe to determine the location of the freepoint of the well pipe or section of well pipe. The tool induces a magnetic field at or near the pipe wall (such as via one or more electromagnetic coils disposed at or near the pipe wall) and detects the corresponding or resulting magnetic Barkhausen noise (such as via one or more sensor coils disposed at or near the pipe wall). The data indicative of the magnetic Barkhausen noise is used to determine the location of the freepoint of the well pipe.

Changes and modifications to the specifically described embodiments may be carried out without departing from the principles of the present invention, which is intended to be limited only by the scope of the appended claims as interpreted according to the principles of patent law including the doctrine of equivalents.

LIST OF COMPONENTS

| | |
|---|---|
| 2 | Magnetic easy axis (MEA) |
| 5 | Rotational force |
| 10 | Production well pipe or drill string |
| 11 | Well casing |
| 12 | Concrete or cement grout |
| 13 | Cemented annulus |
| 14 | Physical restraint |
| 20, 120 | Sensor assembly |
| 21 | Stepper motor |
| 22 | Recording device |
| 23 | Electromagnet |
| 24 | Sine wave generator |
| 25, 25' | Sensor coil |
| 26, 26', 126 | Tool chassis |
| 28a'-c' | Rows of sensors |
| 29 | Shoe |
| 30, 30', 130 | Freepoint locating tool |
| 31 | Shoe roller |
| 32 | Cable |
| 33 | Shoe arm |
| 34 | Shoe plate |
| 100 | Freepoint detection system |

The invention claimed is:

1. A tool disposable within a well pipe, said tool comprising:

an electromagnet capable of inducing a magnetic field within a wall of a well pipe when said tool is disposed within the well pipe; and a Barkhausen noise sensing device capable of sensing magnetic Barkhausen noise in response to said electromagnet inducing the magnetic field within the wall of the well pipe.

2. The tool of claim 1, wherein said electromagnet comprises at least one electromagnetic coil that is rotatable about an axis generally normal to the wall of the well pipe to induce the magnetic field within the wall of the well pipe.

3. The tool of claim 2, wherein said Barkhausen noise sensing device comprises at least one sensor coil that is rotatable about said axis with said at least one electromagnetic coil.

4. The tool of claim 3, wherein said tool comprises a plurality of electromagnetic coils and a plurality of sensor coils disposed at least partially circumferentially around a body of said tool and rotatable about respective axes.

5. A tool disposable within a pipe, said tool comprising:

at least one electromagnetic coil that is rotatable to induce an alternating magnetic field within a wall of a pipe when said tool is disposed within the pipe; and a sensor coil that is rotatable with said at least one electromagnetic coil to sense magnetic Barkhausen noise in response to said at least one electromagnetic coil inducing the alternating magnetic field within the wall of the pipe.

6. The tool of claim 5, wherein said electromagnetic coil and said sensor coil are rotatable about an axis generally normal to the wall of the pipe when said tool is disposed within the pipe.

7. The tool of claim 6, wherein said tool comprises a plurality of electromagnetic coils and a plurality of sensor coils disposed at least partially circumferentially around a body of said tool and rotatable about respective axes.

8. A freepoint detection system for detecting a freepoint of a well pipe, said freepoint detection system comprising:

a tool disposable within a well pipe, said tool comprising at least one electromagnet capable of inducing a magnetic field within a wall of a well pipe when said tool is disposed within the well pipe, and said tool comprising at least one Barkhausen noise sensing device capable of sensing magnetic Barkhausen noise in response to said electromagnet inducing the magnetic field within the wall of the well pipe;

said tool generating an output indicative of the sensed magnetic Barkhausen noise; and wherein said output is processable to determine a freepoint of the well pipe.

9. The freepoint detection system of claim 8, wherein said tool is movable along the well pipe, said tool inducing said magnetic field and sensing said magnetic Barkhausen noise as said tool moves along the well pipe.

10. The freepoint detection system of claim 9, wherein said tool is moved along the well pipe so as make two passes of said tool along the well pipe, with one pass being performed while the well pipe is less stressed and the other pass being performed while the well pipe is more stressed, said output of said tool during a first pass being compared to said output of said tool during a second pass to determine the location of the freepoint of the well pipe.

11. The freepoint detection system of claim 8, wherein said tool is operable to determine a distance traveled by said tool as said tool moves along the well pipe.

12. The freepoint detection system of claim 8, wherein said at least one electromagnet comprises at least one rotatable electromagnetic coil and wherein said at least one Barkhausen noise sensing device comprises at least one rotatable sensor coil, wherein said at least one electromagnetic coil is rotatable to induce the magnetic field into a wall of the well pipe, and wherein said at least one sensor coil is rotatable to sense magnetic Barkhausen noise.

13. The freepoint detection system of claim 8, wherein said tool comprises a plurality of electromagnets and a plurality of Barkhausen noise sensing devices arranged at least partially circumferentially around a housing of said tool.

14. The freepoint detection system of claim 8, wherein said tool comprises a plurality of electromagnets and Barkhausen noise sensing devices selectively arranged along a longitudinal axis of said tool, said longitudinal axis being generally parallel with a longitudinal axis of the well pipe when said tool is disposed within the well pipe, wherein each of said electromagnets and said Barkhausen noise sensing devices are oriented at a respective angle relative to said longitudinal axis of said tool, wherein said freepoint detection system is operable to induce the magnetic field into a wall of the well pipe by selectively energizing said electromagnets as said tool is moved along the well pipe, and wherein said Barkhausen noise sensing devices are operable to sense magnetic Barkhausen noise as the magnetic domains of the well pipe are reoriented.

15. A method of detecting magnetic Barkhausen noise along a well pipe, said method comprising:

providing a detection tool that is movable along a well pipe and that comprises an electromagnet capable of inducing a magnetic field within a wall of the well pipe and a Barkhausen noise sensing device capable of sensing magnetic Barkhausen noise;

inducing a magnetic field into a wall of the well pipe with said electromagnet; and detecting magnetic Barkhausen noise with said Barkhausen noise sensing device.

16. The method of claim 15 further comprising collecting data indicative of the magnetic Barkhausen noise sensed along the well pipe by said Barkhausen noise sensing device.

17. The method of claim 15 further comprising moving said detection tool along a section of the well pipe, wherein inducing a magnetic field and detecting magnetic Barkhausen noise comprise inducing a magnetic field and detecting magnetic Barkhausen noise as said detection tool moves along the well pipe.

18. The method of claim 17, wherein moving said detection tool along a section of pipe comprises making two passes of said detection tool along the section of well pipe, with one pass being performed while the section of well pipe is less stressed and the other pass being performed while the section of well pipe is more stressed, said method further comprising comparing data collected during the two passes to determine the location of the freepoint of the well pipe.

19. The method of claim 15 further comprising processing collected data to determine the location of the freepoint of the well pipe.

20. The method of claim 15 further comprising determining one of (a) a distance traveled by said detection tool as said detection tool moves along the well pipe and (b) a current location of said detection tool along the well pipe.

21. The method of claim 15, wherein providing a detection tool that is movable along a well pipe comprises providing a detection tool that includes at least one rotatable electromagnetic coil and at least one rotatable sensor coil, and wherein inducing a magnetic field into a wall of the well pipe comprises inducing an alternating magnetic field into a wall of the well pipe by rotating said at least one electromagnetic coil while said detection tool is moved along the well pipe, and wherein sensing magnetic Barkhausen noise as the magnetic domains are reoriented comprises sensing magnetic Barkhausen noise via said at least one sensor coil.

22. The method of claim 21, wherein said detection tool comprises a plurality of rotatable electromagnetic coils and a plurality of rotatable sensor coils arranged at least partially circumferentially around a housing of said detection tool.

23. The method of claim 15, wherein providing a detection tool that is movable along a well pipe comprises providing a detection tool that includes a plurality of electromagnetic coils and a plurality of sensor coils selectively arranged along a longitudinal axis of said detection tool, said longitudinal axis being generally parallel with said first direction of travel of said detection tool, each of said electromagnetic coils and said sensor coils arranged along a longitudinal axis of said detection tool being oriented at a respective angle relative to said longitudinal axis of said detection tool, and wherein inducing a magnetic field into a wall of the well pipe comprises inducing an alternating magnetic field into a wall of the well pipe by selectively energizing said electromagnetic coils as said detection tool is moved along the well pipe, and wherein sensing magnetic Barkhausen noise as the magnetic domains are reoriented comprises sensing magnetic Barkhausen noise via said sensor coils.

24. A method of detecting magnetic Barkhausen noise along a well pipe, said method comprising:

providing a detection tool that is movable along a well pipe, said detection tool comprising a Barkhausen noise sensing device capable of sensing magnetic Barkhausen noise;

positioning said detection tool in the well pipe;

inducing a magnetic field into a wall of the well pipe; and detecting magnetic Barkhausen noise with said Barkhausen noise sensing device.

25. The method of claim 24, wherein inducing a magnetic field comprises inducing a magnetic field into a wall of the well pipe via a magnetic element.

26. The method of claim 24 further comprising collecting data indicative of the magnetic Barkhausen noise sensed along the well pipe by said Barkhausen noise sensing device.

27. The method of claim 24 further comprising moving said detection tool along at least a section of the well pipe, wherein inducing a magnetic field and detecting magnetic Barkhausen noise comprise inducing a magnetic field and detecting magnetic Barkhausen noise as said detection tool moves along the well pipe.

28. The method of claim 24, further comprising determining the location of the freepoint of the well pipe responsive to detection of magnetic Barkhausen noise.

29. A sensing system operable to sense magnetic Barkhausen noise in a pipe, said sensing system comprising:

a tool configured to move within and along a well pipe, said tool operable to induce a magnetic field within a wall of the well pipe when said tool is within the well pipe; and a Barkhausen noise sensing device capable of sensing magnetic Barkhausen noise in response to said tool inducing the magnetic field within the wall of the well pipe.

30. The freepoint detection system of claim 29, wherein said Barkhausen noise sensing device generates an output indicative of the sensed magnetic Barkhausen noise.

31. The freepoint detection system of claim 30, wherein said output is processable to determine a freepoint of the well pipe.

32. The freepoint detection system of claim 29, wherein said tool induces said magnetic field and said Barkhausen noise sensing device senses magnetic Barkhausen noise as said tool moves along the well pipe.

33. The freepoint detection system of claim 29, wherein said tool comprises a magnetic element operable to induce said magnetic field within the wall of the well pipe.

* * * * *

UNITED STATES PATENT AND TRADEMARK OFFICE

CERTIFICATE OF CORRECTION

PATENT NO. : 8,035,374 B1
APPLICATION NO. : 12/245054
DATED : October 11, 2011
INVENTOR(S) : Bruce I. Girrell et al.

It is certified that error appears in the above-identified patent and that said Letters Patent is hereby corrected as shown below:

Column 8
Line 27, "MBA" should be --MEA--

Signed and Sealed this
Tenth Day of January, 2012

David J. Kappos

David J. Kappos
*Director of the United States Patent and Trademark Office*